US007959545B2

(12) United States Patent
Olexenko

(10) Patent No.: US 7,959,545 B2
(45) Date of Patent: Jun. 14, 2011

(54) WALKING AID

(76) Inventor: Dmitry Olexenko, New Berlin, WI (US)

( * ) Notice: Subject to any disclaimer, the term of this patent is extended or adjusted under 35 U.S.C. 154(b) by 0 days.

(21) Appl. No.: 12/030,760

(22) Filed: Feb. 13, 2008

(65) Prior Publication Data

US 2008/0230103 A1 Sep. 25, 2008

Related U.S. Application Data

(60) Provisional application No. 60/918,852, filed on Mar. 20, 2007.

(51) Int. Cl.
*A63B 23/00* (2006.01)
*A61H 3/00* (2006.01)

(52) U.S. Cl. ..... 482/148; 135/67; 280/87.021

(58) Field of Classification Search ..... 482/66–69, 482/132, 148; 135/67; 280/87.021
See application file for complete search history.

(56) References Cited

U.S. PATENT DOCUMENTS 1,668,623 A * 5/1928 Avril ..... 280/87.021
2,484,494 A * 10/1949 Ferguson ..... 2/24
4,765,355 A 8/1988 Kent
4,768,536 A * 9/1988 Hawkins ..... 135/67
4,861,051 A 8/1989 Napper
4,890,853 A 1/1990 Olson
5,152,730 A 10/1992 Hoffman
5,427,391 A 6/1995 Cooper
5,676,388 A 10/1997 Bertani
5,725,224 A * 3/1998 Kerr ..... 280/11.19
5,746,236 A 5/1998 Tilsley et al.
5,839,740 A * 11/1998 Seeger ..... 280/87.021
5,870,774 A 2/1999 Legenstein
6,053,189 A * 4/2000 Longenecker et al. ..... 135/67
6,494,919 B1 * 12/2002 Matthews ..... 623/32
6,634,660 B2 * 10/2003 Miller ..... 280/87.021
7,040,637 B2 5/2006 Owens et al.
7,303,516 B2 12/2007 Petersen
7,303,537 B1 * 12/2007 Snyder et al. ..... 602/16
7,445,217 B1 * 11/2008 Price ..... 280/87.021
2003/0094191 A1 5/2003 Lin
2004/0012165 A1 * 1/2004 Miller ..... 280/87.01
2005/0278038 A1 12/2005 Ikeda
2007/0265144 A1 11/2007 Jackson et al.

* cited by examiner

*Primary Examiner* — Fenn C Mathew
(74) *Attorney, Agent, or Firm* — Absolute Technology Law Group, LLC

(57) ABSTRACT

An apparatus comprised of: a base unit having a top portion and a bottom portion; a leg supporting structure on the top portion at an angle and adapted to receive the lower portion of a user's leg; one or more temporary securing member(s) to temporarily secure the user's leg to the leg supporting platform; and at least one rolling member positioned below the bottom portion, such that the user is able to move using a free leg and the apparatus without the use of hands.

20 Claims, 5 Drawing Sheets

WALKING AID

CROSS-REFERENCE TO RELATED APPLICATIONS

This application claims the benefit of and priority to U.S. provisional application Ser. No. 60/918,852, filed on Mar. 20, 2007 and incorporated herein in its entirety.

FIELD OF INVENTION

This invention relates generally to the field of medical assistance devices, and in particular to an apparatus that allows a user with a foot or ankle injury to increase mobility.

BACKGROUND

There a number of foot and ankle injuries that can affect a person's use of a foot or ankle (including but not limited to bone, tendon, tissue, muscle, spasms and strains, stress-related injuries, compression injuries, skin irritations, burns, bunions, toe pain, nail injuries, swelling, arch pain, amputations, congenital defects, paralysis, impaired mobility and all other known injuries which may occur to a foot or ankle.)

Crutches, walkers and other devices which rely primarily on increasing the weight placed by hands and arms to facilitate mobility can result in discomfort, physical strain and fatigue (e.g., underarm discomfort from crutches). Additionally, users may have varying levels of upper body strength. Scooters, wheelchairs, and crutches may prevent leg muscles from being properly exercised during recuperation and reduce overall movement, and cannot be used in all areas and surfaces. Additionally, such devices are costly and prone to mechanical failure and wear. Use of the above devices can negatively impact the strength of the surrounding, non-injured leg muscles, because they are not used sufficiently during the period of convalescence and may weaken or atrophy.

There exists a need in the art to provide a device that offers mobility to people suffering from lower limb, foot and ankle injuries or impairments (e.g., injuries, amputations, degenerative conditions, and birth defects) which increases mobility without the associated problems of those devices currently in use.

GLOSSARY

As used herein, the term "rolling member" shall refer to any element or system that allows the walking aid to roll or glide along a surface, including but not limited to wheels, casters, turning casters, gliders, resistence or friction reducing components, and studs. A rolling member may also include legs, rubber components, or other components which may be temporarily interchanged with wheels and casters for use in a shower, tub, slippery surfaces, wet and uneven surfaces. Thus, the term rolling member, as used herein, is not limited to components which provide rolling motion. Rolling member shall refer to any component which is used as part of the system of the walking aid described herein to provide an appropriate level of mobility and adaptation to a user to maximize the range of activities they can perform with a foot or ankle injury, and further includes temporarily stabilizing members when rolling is not safe or desirable (e.g., in the shower). A rolling member further includes devices which operate as a brake and control the level of resistance of the rolling member. A rolling member may further include a spring mechanism which cushions impact at the point of attachment of the rolling member to the walking aid, and provides smoother rolling motion on rough or non-uniform surfaces. Also shown in FIG. 5 is spring component 199, which is attached at the point of attachment of rolling members 135 to the bottom portion of outer shell 101, and which allows the wheel to absorb impact and vibrations. A rolling member may include a spring at the point of attachment which to absorb impact and vibrations.

As used herein, the term "leg supporting structure" shall refer to a structure which engages the patient's lower leg, knee and potentially upper leg, and which may further provide side-to-side support and rigidity. A leg supporting structure further allows the user to maintain a comfortable bended knee angle (i.e., angle at which the knee is bended) for prolonged standing and/or movement by a user. The bended knee angle may be different for each user, but generally ranges from 30 to 110 degrees using various anthropometric measurements taken at various points.

As used herein, the term "securing member" shall refer to a strap, a system of straps, a sleeve or a tubular member, a shell or sleeve which contracts and expands, a pivotal component of the leg supporting member (e.g. a securing bar) or a flexible component to create pressure or which functions to secure or position a lower extremity to a leg supporting structure. A securing member may provide additional support and rigidity, and may be released or opened.

As used herein the term "height adjustment mechanism" means any mechanism or system of components for adjusting the height or accommodation of the position of the leg supporting structure relative to the floor or ground to accommodate the height, injury or physical attributes of a user. For example, the position of the base unit may be adjusted by inserting additional pieces in a base unit to extend height, or by using a telescoping base unit mechanism (in which a portion of the base unit descends within the base unit structure), either of which may be secured by bolts, clamps, spring clamps, rods, hook bolts, anchoring bolts or securing bolts, clamps, screws, a spring-loaded pin having a system of apertures, pins for securing or any combination thereof.

As used herein the term "orientation" or "direction of pivot" means the angle of the rotational plane of rolling member to the center line of leg supporting member.

As used herein the term "pivot control mechanism" means a mechanism which controls the direction of a rolling member, and which causes the rotational plane of the rolling member to become parallel or directs the angle of rotation of the rolling member relative to the center line of the apparatus. A pivot control mechanism may include a lever, a cord, a tie, a rod, a weight or a strategically bended component which causes a direction of pivot.

SUMMARY OF THE INVENTION

The present invention is an orthotic walking aid comprised of: a leg supporting structure having top and bottom portions; a leg supporting structure on the top portion adapted to receive a lower portion of the user's leg; one or more temporary securing member(s) to temporarily secure the user's leg to the leg supporting platform; and at least one rolling member below the bottom portion. The user can move without having to use their hands to operate the apparatus. The apparatus can include a height adjustment member and the leg supporting structure can be angled downward at the rear and/or can be positioned rearward of the center of the apparatus.

Walking aid 100 can assist many types of users; any person with a condition below the knee, i.e., anyone that can bend their knee to rest their lower extremity on walking aid 100 can use the device, as well as those lacking a lower extremity. Walking aid 100 may accommodate a wide range of foot or ankle conditions, injuries and deformities including but not limited to, bone, tendon, tissue, and muscle spasms and strains, stress-related injuries, compression injuries, skin irritations, burns, bunions, toe pain, nail injuries, swelling, arch pain, amputations, congenital defects, paralysis, impaired mobility and all other known injuries which may occur to a foot or ankle.

For example, walking aid 100 is suitable for people who have had foot surgery, those wearing a foot, ankle, or lower leg cast, diabetics with Charcot joint disease, ulcers or other complications, patients with bunionectomies, Achilles tendon problems, and foot reconstruction, patients with neuromuscular problems or arthritis, as well as those with amputations or birth defects.

One benefit of walking aid 100, in addition to maintaining mobility, is that leg 50 engaging walking aid 100 must have weight put on it, resulting in leg 50 being exercised, maintaining musculature circulation and potentially aiding in the healing of leg 50, without ever having to put weight on the injured foot (for those using walking aid 100 that have an injured foot). In addition, amputees can use walking aid 100 at night (e.g., for going to the bathroom) without having to attach a prosthesis.

DETAILED DESCRIPTION OF EMBODIMENTS OF THE INVENTION

Figure 1:
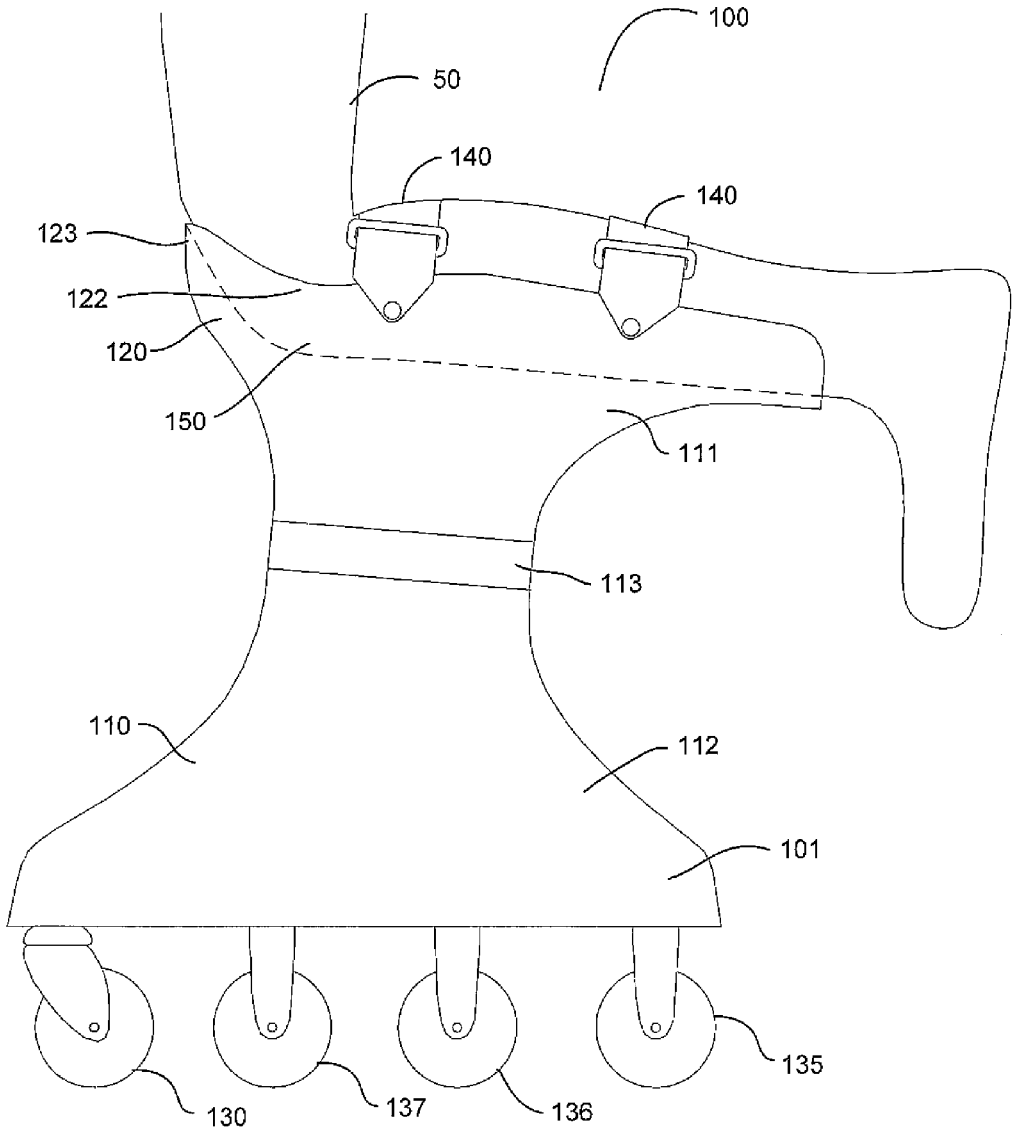
FIG. 1 shows a side view of one embodiment of the walking aid.

For the purpose of promoting an understanding of the present invention, references are made in the text hereof to embodiments of a walking aid, only some of which are described herein. It should nevertheless be understood that no limitations on the scope of the invention are thereby intended. One of ordinary skill in the art will readily appreciate that modifications such as the dimensions of the rolling walking aid, alternate but functionally similar material(s) from which the walking aid is made, and the inclusion of additional elements are deemed readily apparent and obvious to one of ordinary skill in the art, and all equivalent relationships to those described in the written description do not depart from the spirit and scope of the present invention. Some of these possible modifications are mentioned in the following description. Therefore, specific details disclosed herein are not to be interpreted as limiting, but rather as a basis for the claims and as a representative basis for teaching one of ordinary skill in the art to employ the present invention in virtually any appropriately detailed apparatus or manner.

It should be understood that the drawings are not necessarily to scale, emphasis instead being placed upon illustrating the principles of the invention. In addition, in the embodiments depicted herein, like reference numerals in the various drawings refer to identical or near identical structural elements.

Moreover, the term "substantially" or "approximately" as used herein may be applied to modify any quantitative representation that could permissibly vary without resulting in a change in the basic function to which it is related. For example, one embodiment of the walking aid as disclosed herein is cylindrically contoured to accommodate a user's leg. Other embodiments may have varying sized shapes (e.g, more or less flattened, curved or longer or shorter) and be singly molded or consist of assembled components having the same function as features of the invention described herein.

Referring now to the drawings, FIG. 1 shows a side view of one (1) embodiment of walking aid 100 which includes singly molded outer shell 101. Outer shell 101 may consist of separately assembled parts or may be a singly molded outer structure. In the embodiment shown, walking aid 100 is comprised of base unit 110 (which may be a separately constructed component or a functional portion of a singly molded structure), leg supporting structure 120 (which may be separately constructed or a functional portion of a singly molded structure), and a variable number of rolling members 130, 135, 136 and 137. In the embodiment shown, there are four rolling members, but other embodiments may have one to six rolling members. Base unit 110 includes top portion 1111 bottom portion 112, and center portion 113. As can be seen, top portion 111 and bottom portion 112 have a larger cross-sectional area as compared to center portion 113, thus providing greater stability to walking aid 100, thus creating a device with an astroid-shaped profile. However, it should be understood that the invention should not be limited to any particular shape of walking aid 100, but can be of almost any shape, including those that are more aesthetic, as long as the ability to support the user is not lost.

Also visible is leg supporting structure 120 positioned at top portion 111 of base unit 110. The user's leg 50 is positioned on leg supporting structure 120. In the embodiment shown, leg supporting structure 120 includes rounded sides 122, generally shaped or adapted to receive leg 50. However, it should be understood that leg supporting structure 120 can be substantially flat or any other shape that allows leg 50 to be supported in the manner of leg supporting structure 120. In addition, an embodiment of walking aid 100 in which leg supporting structure 120 is substantially flat.

Also included in the embodiment of walking aid 100 shown in FIG. 1 (in dashed lines) is pad 150, which is positioned between leg 50 and leg supporting structure 120. Pad 150 cushions leg 50 when placed on walking aid 100 to provide greater comfort to the user. Pad 150 can be positioned below the knee, i.e., where most of the user's weight would be, can extend the length of leg supporting structure 120, or can be positioned over only a portion of leg supporting structure 120. However, it should be understood that pad 150 is not necessarily a separate element and walking aid 100 need not include pad 150. Additionally, leg supporting structure 120 could be constructed from a material that is sufficiently shock absorbing and comfortable to eliminate the need for pad 150. In the embodiment shown pad 150 is any padding or lining which fits within leg supporting structure 120. Further, walking aid 100 may include multiple pads, liners, cushioning and padded clothing all of which may be collectively referred to as pad 150.

In the embodiment shown, walking aid 100 is constructed as a single integrated structure. However, in alternate embodiments, as will be discussed infra with respect to FIG. 3, walking aid 100 can be constructed as multiple components to include outer shell 101 which may be a complete or partial outer shell 101 for the components of walking aid. In the embodiment shown, outer shell 101 is made of fiberglass, but can also be made of injection molded ABS, plastics, wood, metal, tubular metal units, metal posts, a metal frame structure, resin, synthetic or other materials capable of bearing weight of a user. Walking aid 100 can also be made as a solid device or be hollow if its ability to support the weight of the user is not compromised.

Also visible in FIG. I are rolling members 130, 135, 136 and 137 which are positioned below base unit 110. Rolling members 130, 135, 136 and 137 allow walking aid 100 to move as the user pushes with the leg without engaging hands or arms. In the embodiment shown, rolling members 130, 135, 136 and 137 are four (4) caster wheels: two (2) forward caster wheels (i.e., under the knee) and two (2) rearward caster wheels (i.e., under the user's ankle). However, any number of rolling members 130, 135, 136 and 137 can be used with walking aid 100. Rolling members 130, 135, 136 and 137 can swivel or can be fixed in position. In addition, those rolling members 130, 135, 136 and 137 that swivel can freely swivel or can be "resistant swivel," such that when pushed by the user, rolling members 130, 135, 136 and 137 swivel, but return to forward facing when the user stops pushing leftward or rightward. In addition, all rolling members 130, 135, 136 and 137 need not be of the same type on each embodiment of walking aid 100. For example, in one embodiment, forward rolling members 130, 137 are resistant swivel casters and rearward rolling members 135, 136 are fixed casters. Furthermore, rolling members 130, 135, 136 and 137 can have various sizes. Rolling members 130, 135, 136 and 137 can have an outer diameter between approximately three inches (3") and approximately eight inches (8"), and can further include a urethane coating, plastic, rubber, resin, synthetic, natural or other coating known in the art to allow rolling members 130, 135, 136 and 137 to move more freely and smoothly.

In addition, in alternate embodiments of walking aid, rolling members 130, 135 can be replaced by rigid structures. For example, the bottom surface of walking aid 100 can include studs or legs (not shown) rather than wheels. Such embodiments are especially suited for thick carpets, soft grounds, slippery or wet surfaces (including a shower), uneven or rough surfaces, non-horizontal surfaces, steps, or other surfaces in which a walking aid 100 would be unwanted or impractical. Thus, although such rigid structures do not roll, they allow a user of walking aid 100 to be mobile and it is intended that such structures are included within the term "rolling members."

In the embodiment of walking aid shown in FIG. 1, the position of rolling members 130, 135 is fixed. In still further alternate embodiments of walking aid 100, rolling members 130, 135 can further include an adjustment mechanism that allows the position of rolling members 130, 135, 136 and 137 to be modified such that rolling members 130, 135, 136 and 137 can be moved forward and rearward and/or inward and outward on bottom portion 112, allowing walking aid 100 to be tailored for a specific use or user.

Also visible in the embodiment of walking aid 100 shown in FIG. 1 are temporary securing members 140. Temporary securing members 140 temporarily secure the user's leg 50 to walking aid 100. In the embodiment shown, temporary securing members 140 are each a strap with a hook and loop mechanism for securing one portion to the other. Other embodiments can include clips, snaps, buckles, or any other device that allows the two (2) portions of each temporary securing member 140 to be temporarily secured around the user's leg 50 when walking aid is in use. Moreover, the embodiment shown includes two (2) temporary securing members 140, but can include any number. In the embodiment shown, temporary securing members 140 are two (2) one and one half inch (1½") polypropylene webbing, but can be of any size or sufficiently flexible material such as plastic or fabric. In addition, although not shown, each temporary securing member 140 can further include one (1) or more pads to provide additional comfort to the user.

Whether the user's leg 50 is temporarily secured to leg supporting structure 120 by temporary securing members 140 or positioned within leg supporting structure 120 and prevented from slipping by rounded sides 122 and front 123, walking aid 100 thus provides the user mobility without requiring the use of their hands while in use. The user relies upon their uninjured leg (not shown) to push themselves and therefore is able to move without the use of hands or arms. Hands may be used in engaging, positioning or releasing components of walking aid 100.

In still another embodiment of walking aid 100, walking aid 100 can be motorized for stretches of sidewalk or hallways. In some embodiments, controls may be a hand held module that control walking aid 100 by radio waves, for example, or hard wired to walking aid 100.

Figure 2:
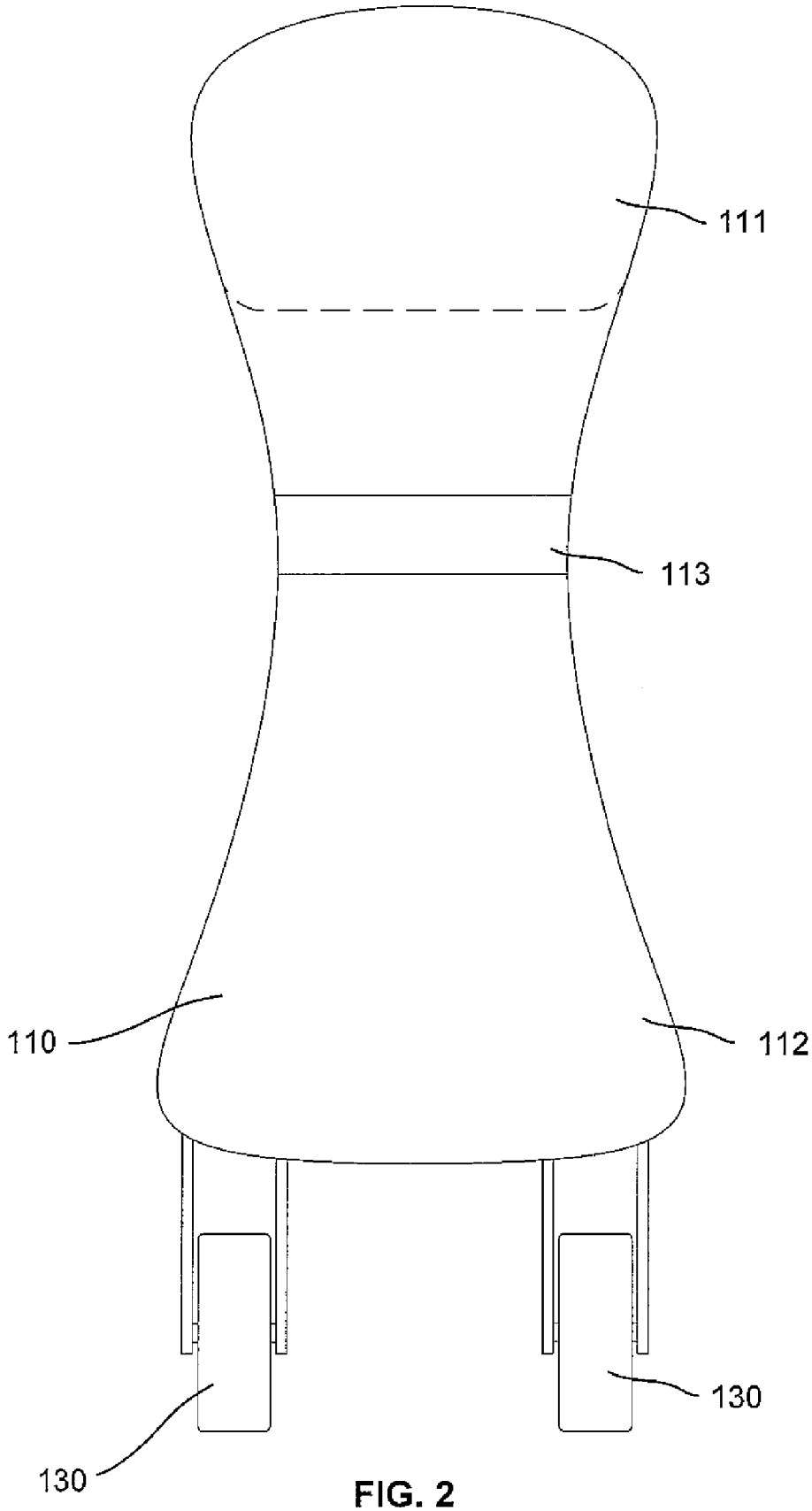
FIG. 2 shows a front view of the embodiment of the walking aid.

FIG. 2 shows a front view of the embodiment of the walking aid shown in FIG. 1 taken along line 2 of FIG. 1. As can be seen, center portion 113 has a smaller cross-section as compared to top portion 111 and bottom portion 112. However, walking aid 110 can have any shape (as viewed from this perspective) so long as the functionality of walking aid 100 remains. As can also be seen, walking aid 100 is symmetrically constructed. This makes walking aid 100 suitable for use for either the right or left leg 50; however walking aid 100 may be constructed specifically for a user having a right or left leg injury.

Figure 3:
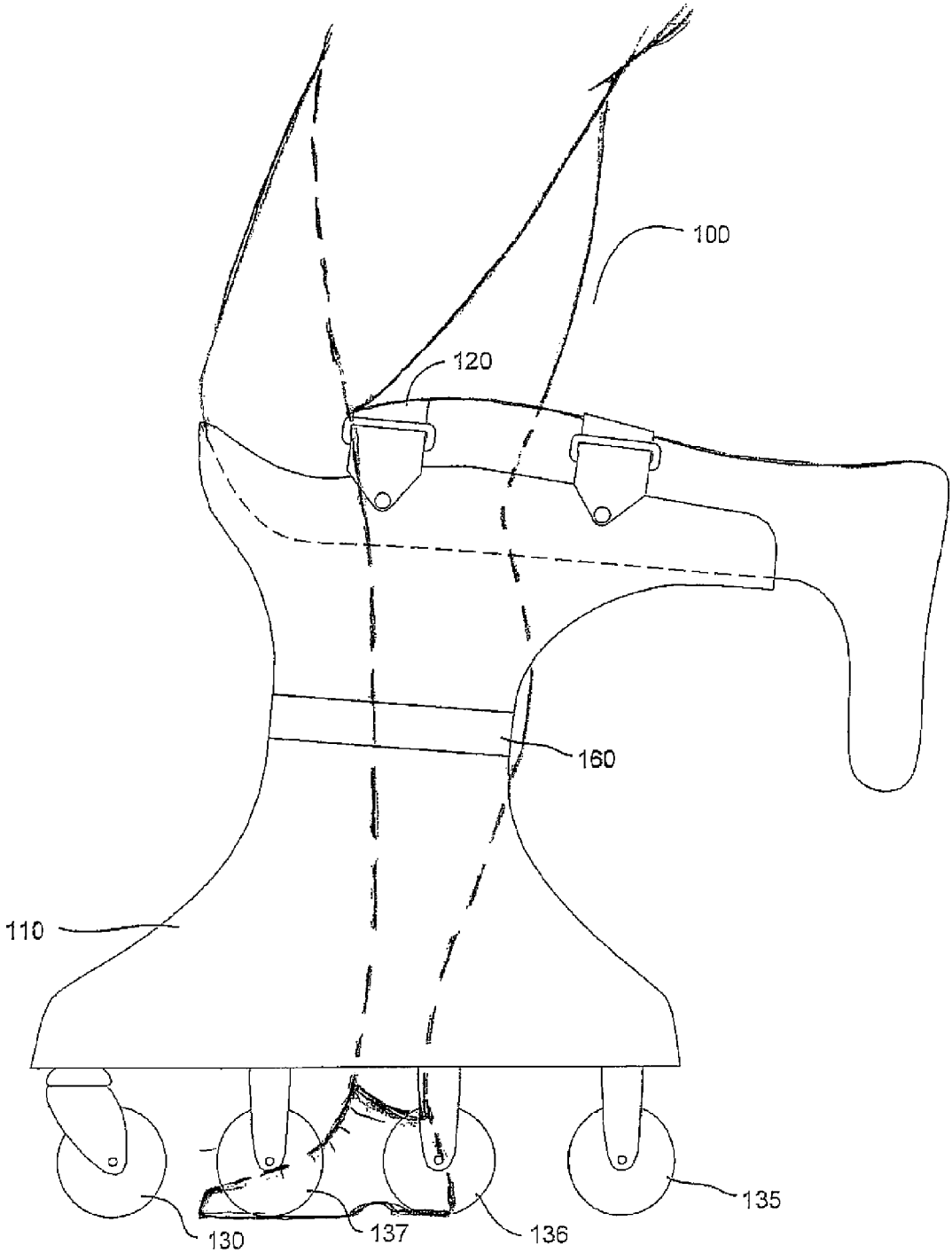
FIG. 3 shows a side view of one alternate embodiment of the walking aid further including a height adjustment mechanism.

FIG. 3 shows a side view of an alternate embodiment of walking aid 100 further including height insert 160 which is an additional, removable piece of base unit which may be used in connection with adjustment mechanism (defined above) to adjust walking aid to the height of a user. In the embodiment shown, height adjustment mechanism includes height insert 160 which allows the height of walking aid 100 to be adjusted to accommodate various sized users (i.e., a height adjustment mechanism), thus allowing the distance between leg supporting structure 120 and the ground below walking aid 100 to be adjusted for users of different heights. In an embodiment of walking aid 100 that includes a height adjustment member, walking aid 100 is made of at least two (2) separate components. That is, base unit 110 includes separated top portion 111 and bottom portion 112, which are temporarily secured to one another by any mechanism commonly known and used in the art. When the height of walking aid 100 is to be increased, top portion 111 is separated from bottom portion 112 and insert 160 is positioned therebetween. Top portion 111 is then secured to the top of insert 160 and bottom portion 113 is secured to the bottom of insert 160. The height of walking aid 100 and the elevation of leg supporting structure 120 are thus increased. As non-limiting examples, insert 160 could be one inch (1") or two inches (2") thick. In addition, multiple inserts 160 of varying thicknesses may be used to provide greater flexibility between the heights of multiple users using the same walking aid 100.

For example, walking aid 100 can be made in three (3) different sizes: the first is approximately twenty inches (20") tall (as measured at leg support platform 120) the second is approximately eighteen inches (18") tall, and the third sixteen inches (16") tall. The first would be usable by persons of at least six feet (6') tall, with inserts or other height adjustment mechanisms enabling walking aid 100 to be usable by persons up to six foot eight inches (6' 8") tall. The second would be usable by persons approximately five foot four inches (5' 4") tall and up to six foot two inches (6' 2") tall with the use of insert(s) 160 or another height adjustment mechanism. The third would be usable by persons approximately four foot eight inches (4' 8") tall and up to five foot four inches (5' 4") tall with the use of insert(s) 160 or another height adjustment mechanism.

Figure 4:
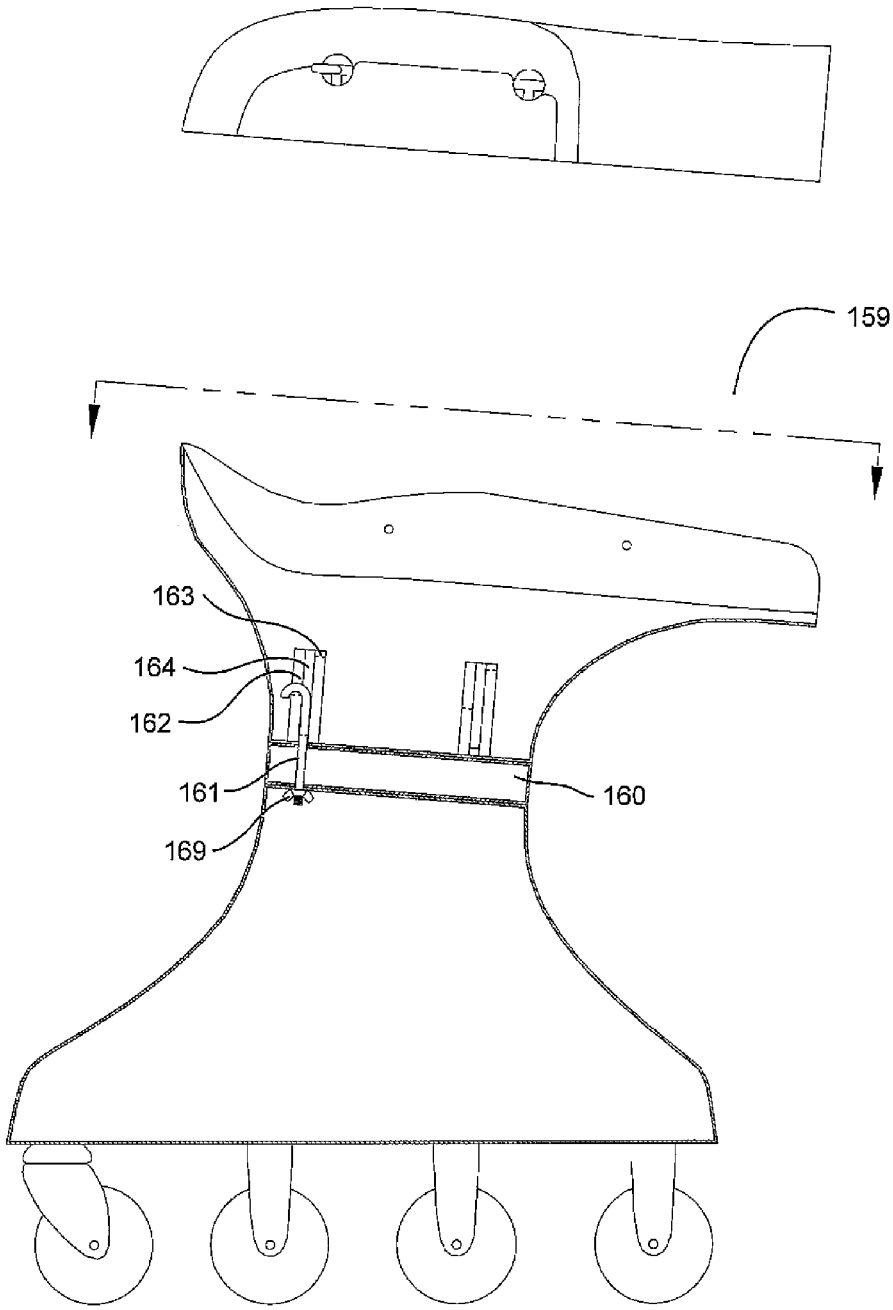
FIG. 4 shows one embodiment of a height adjustment mechanism.
Figure 5:
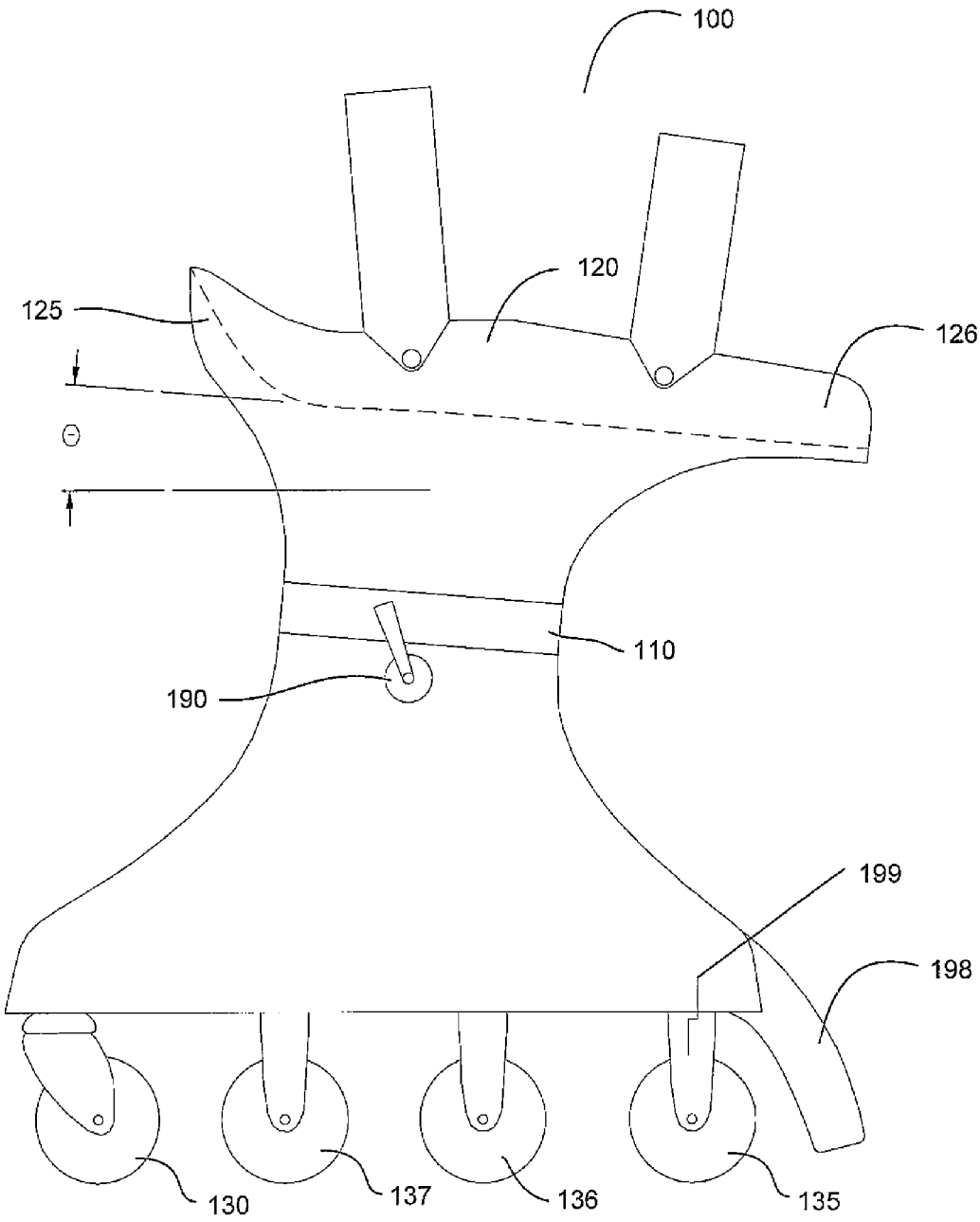
FIG. 5 shows a side view of an embodiment of walking aid further including a brake mechanism, a modified angle of orientation, and a pivot control mechanism.

FIG. 4 illustrates an exemplary height adjustment mechanism 159. The position of a base unit may be adjusted by inserting additional height insert(s) 160 in a base unit to extend height, securing the additional pieces in place by anchor bolts 161 and slots 162, 163 and 164, placed at different height intervals, and secured with bolts 169. In FIG. 5 shows a side view of leg supporting structure 120. For better steering (i.e., "drivability"), especially on carpeted and other soft surfaces, leg supporting structure 120 can be positioned at an incline in relation to the ground, with forward portion 125 being elevated relative to rearward portion 126, thus providing a forward propelling force when the user's weight is applied. The degree to which forward portion 125 can be elevated as compared to rearward portion 126 (as indicated by θ) can vary, but in the embodiment shown, forward portion 125 is elevated at an angle relative to parallel to the ground of approximately thirty degrees (30°), but forward portion 125 can be elevated at almost any angle that provides increased drivability and/or comfort for the user. FIG. 5 further shows pivot control mechanism 190 which, in this embodiment, is a system of cables attached at one end of a rolling member to control the level of resistance to pivoting. In other embodiments pivot control mechanism may be a device which is engaged mechanically or electronically to achieve the same result. Pivot control mechanism 190 may also act as a braking system.

Also shown in FIG. 5 is stabilizing stop/brake members 198 which, in the embodiment shown, operate as a brake and prevents the walking aid tipping (e.g., if the user shifts their weight too far back or is going down a ramp.) Other embodiments may include an additional symmetrical or multiple stabilizing stop/brake members. Other embodiments of the invention may also omit this component or have it on fewer or all members.

While the walking aid has been shown and described with respect to several embodiments and uses in accordance with the present invention, it is to be understood that the same is not limited thereto, but is susceptible to numerous changes and modifications as known to a person of ordinary skill in the art, and it is intended that the present invention not be limited to the details shown and described herein, but rather cover all such changes and modifications obvious to one of ordinary skill in the art.

What is claimed is:

1. A hands-free walking aid apparatus comprised of:

an asteroid-shaped base unit having at least two rounded sides, said base unit having a top portion and a bottom portion which can be adjusted for height by using a selectively removable insert component;

a separately attached singly molded rigid leg supporting structure positioned at an incline enabling a bended knee to be positioned at an angle ranging from 30 to 110 degrees relative to a horizontal plane, said leg supporting structure is positioned on said top portion of said base unit and adapted to receive a lower portion of a user's leg;

at least one securing member to temporarily secure said lower portion of said user's leg to said leg supporting structure; and four independently rotating casters capable of steering said base unit, said independently rotating casters positioned below said bottom portion of said base unit;

wherein at least one of said independently rotating casters is fixed and at least one of said independently rotating casters is capable of pivotal movement;

wherein a user of said apparatus is able to move using an uninjured leg and said apparatus without the use of the user's hands.

2. The apparatus of claim 1, wherein said apparatus further includes at least one height adjustment mechanism.

3. The apparatus of claim 1, wherein said leg supporting structure is positioned at an angle relative to a ground surface.

4. The apparatus of claim 1, wherein said separately attached leg supporting structure further includes at least one pad.

5. The apparatus of claim 1, wherein each of said at least one securing member is a strap.

6. The apparatus of claim 1, wherein each of said four independently rotating casters is selected from a group consisting of a caster, a wheel, a turning caster, a glider, a stud, a leg and a rubber component.

7. The apparatus of claim 1, wherein at least one of said four independently rotating casters is non-pivotal.

8. The apparatus of claim 1, wherein at least one of said four independently rotating casters has an orientation which may be adjusted.

9. The apparatus of claim 8, which further includes a pivot control mechanism.

10. The apparatus of claim 1, which further includes a pivot control mechanism attached to at least one of said four independently rotating casters and is selected from a group consisting of a lever, a cord, a tie, a rod, a stop or a stand and which controls the rotational plane of the pivotal member.

11. The apparatus of claim 1, which further includes a motor.

12. A hands-free walking aid system that allows a user of said device to move using a free leg and said apparatus without requiring use of said user's hands, said device comprised of:

an asteroid-shaped base unit having at least two rounded sides, said base unit having a top portion and a bottom portion;

a separately attached singly molded rigid angled leg supporting structure positioned on said top portion of said base unit and adapted to receive a lower portion of a user's leg;

wherein said leg supporting structure is positioned at an incline enabling a bended knee to be positioned at an angle ranging from 30 to 110 degrees relative to a horizontal plane;

at least one securing member to temporarily secure said lower portion of said user's leg to said leg supporting platform;

four independently rotating casters capable of steering said base unit, said four independently rotating casters positioned below said bottom portion of said base unit;

wherein at least one of said independently rotating casters is fixed and at least one of said independently rotating casters is capable of pivotal movement; and at least one height adjustment mechanism, wherein said height adjustment mechanism is a selectively removable insert component which allows the height of said device to be changed.

13. The system of claim 12, wherein said separately attached angled leg supporting structure is positioned at an angle relative to a ground surface.

14. The system of claim 12, wherein said separately attached angled leg supporting structure further includes at least one pad.

15. The system of claim 12, wherein each of said at least one securing member is a strap.

16. The system of claim 12, wherein at least one of said four independently rotating casters is selected from a group consisting of a caster, a wheel, a turning caster, a stud, a leg and a rubber component.

17. The system of claim 12, wherein at least one of said four independently rotating casters is non-pivotal.

18. The system of claim 12, which further includes a pivot control mechanism.

19. The system of claim 12, which further includes a pivot control mechanism attached to at least one of four independently rotating casters and is selected from a group consisting of a lever, a cord, a tie, a rod, a stop or a stand and which controls the rotational plane of the pivotal member.

20. The system of claim 12, which further includes a motor.

* * * * *